US005701128A

United States Patent [19]

Okada et al.

[11] Patent Number: 5,701,128

[45] Date of Patent: Dec. 23, 1997

[54] ANTENNA-INTEGRATED STRIP LINE CABLE

[75] Inventors: Takekazu Okada, Ishikawa-ken; Yuichi Maruyama, Nagaokakyo; Kazuya Sayanagi, Osaka, all of Japan

[73] Assignee: Murata Manufacturing Co., Ltd., Japan

[21] Appl. No.: 609,497

[22] Filed: Mar. 1, 1996

[30] Foreign Application Priority Data

Mar. 3, 1995 [JP] Japan ..... 7-044495

[51] Int. Cl.[6] ..... H01Q 1/38; H01Q 1/24

[52] U.S. Cl. ..... 343/700 MS; 343/702; 343/846

[58] Field of Search ..... 343/700 MS, 702, 343/829, 846, 848, 895; H01Q 1/38, 1/24

[56] References Cited

U.S. PATENT DOCUMENTS 4,131,894 12/1978 Schiavone ..... 343/700 MS

FOREIGN PATENT DOCUMENTS 309039 3/1989 European Pat. Off. ..... H01Q 1/24

4-179302 6/1992 Japan ..... H01Q 1/24

*Primary Examiner*—Hoanganh T. Le

*Attorney, Agent, or Firm*—Ostrolenk, Faber, Gerb & Soffen, LLP

[57] ABSTRACT

An antenna-integrated strip line cable with which it is possible to improve the performance of a high-frequency appliance such as a portable telephone without making the appliance larger. An antenna-integrated strip line cable 1 is made up of a transmission line part 2, an antenna part 3 and a counterpoise 4. The transmission line part 2 is made up of two conductors 21, 22 disposed in parallel, insulators 23, 24 having plasticity or flexibility disposed between these two conductors 21, 22, and a central conductor 25 disposed between the insulators 23, 24 centrally in the width direction thereof. Wide-pattern impedance matching circuits 26a, 26b are provided in the central conductor 25. The antenna part 3 has portions of the insulator 24 and the central conductor 25 extending from the transmission line part 2. The counterpoise 4 has portions of the insulator 23 and the conductor 21 extending from the transmission line part 2. The counterpoise 4 is perpendicular to the antenna part 3 and the length of the counterpoise 4 is about one-fourth of the wavelength λ of the frequency used. Some benefits of this novel construction are that the number of parts is reduced, the work of connecting a coaxial cable to an antenna is made unnecessary, the counterpoise reduces directivity of the antenna part, the antenna is tough, and it is not necessary to provide an impedance matching circuit externally.

19 Claims, 10 Drawing Sheets

FIG. 1
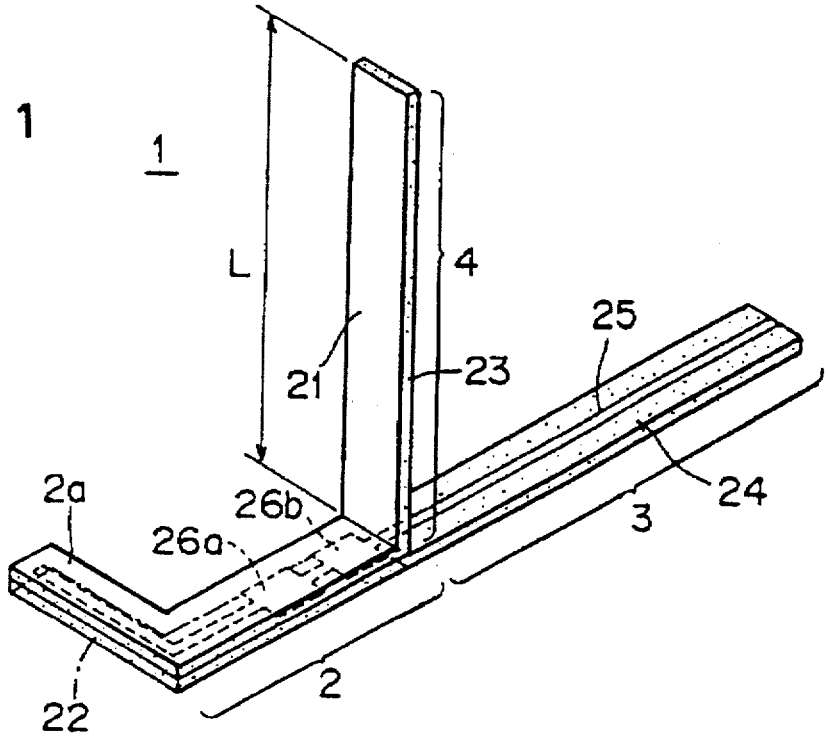
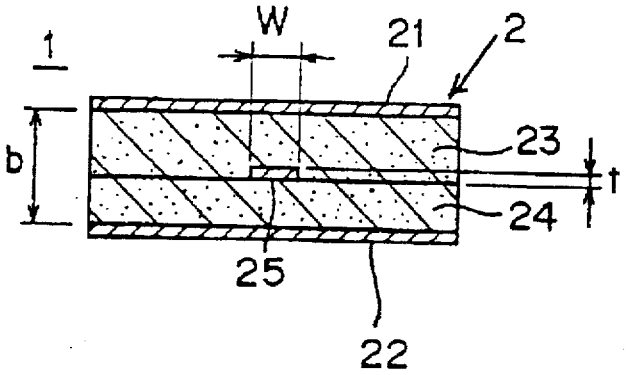
FIG. 2
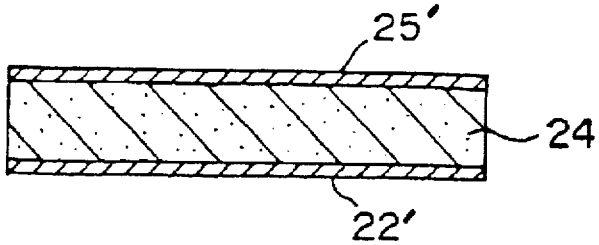
FIG. 3

FIG. 7
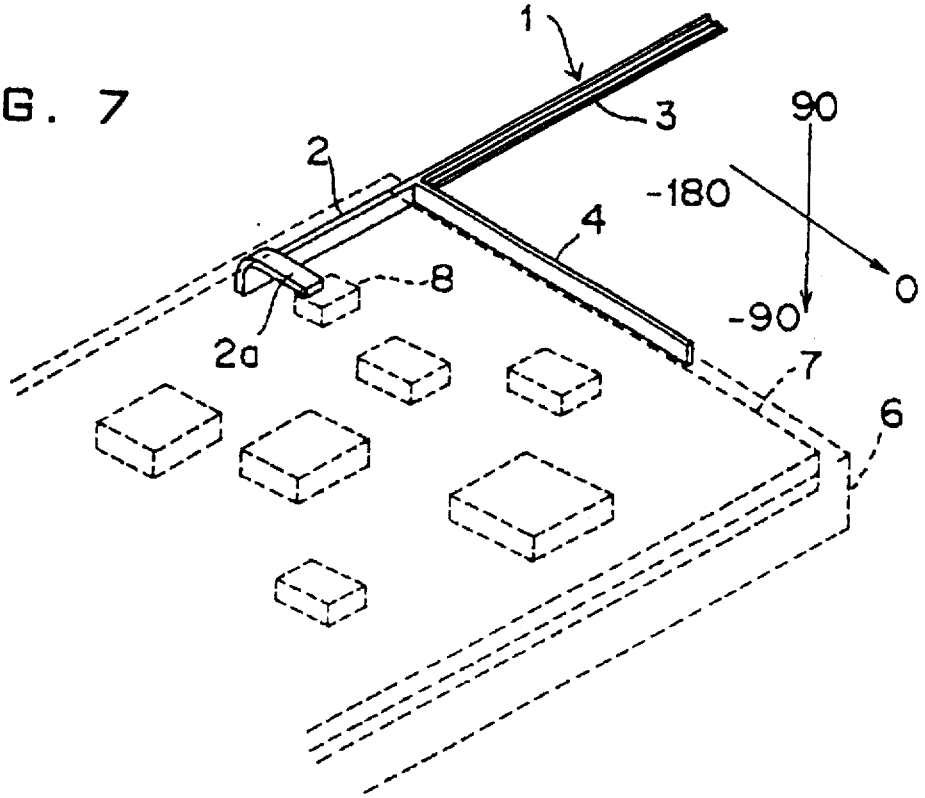
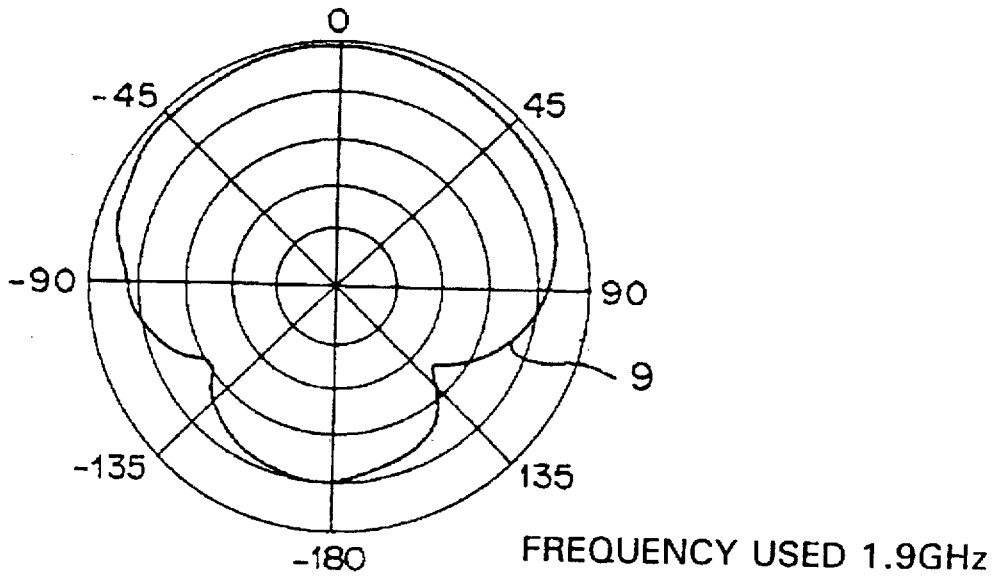
FIG. 8

FIG. 9
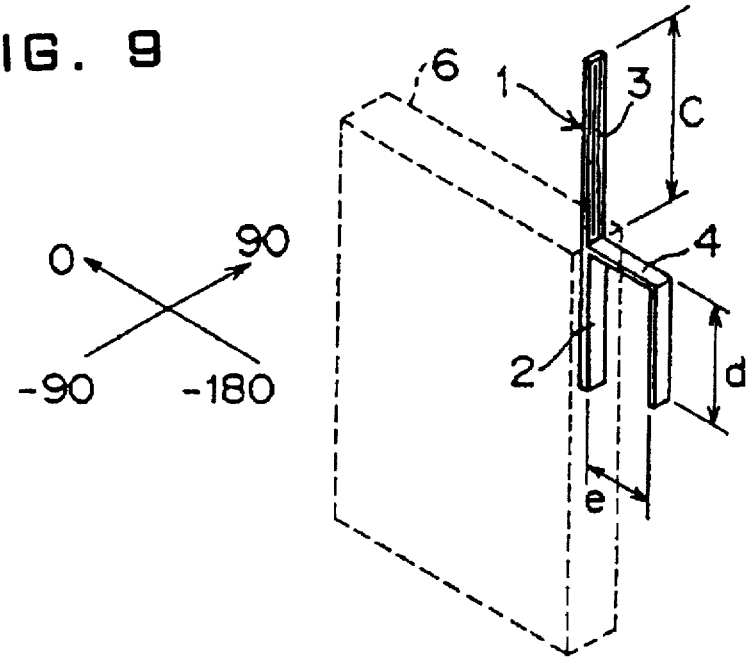
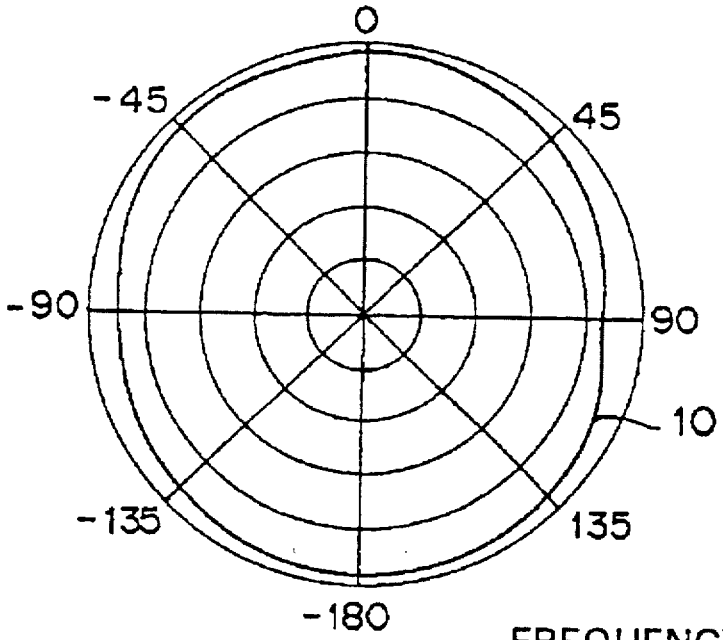
FREQUENCY USED 1.9GHz
FIG. 10

FIG. 15
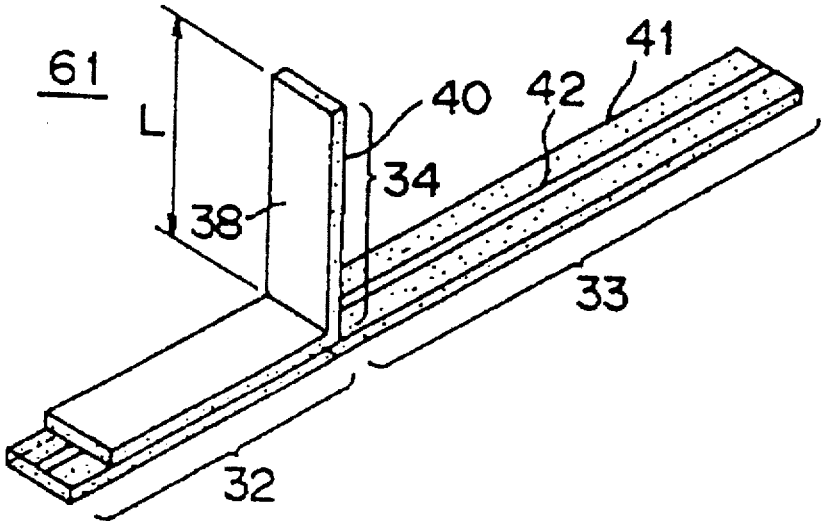
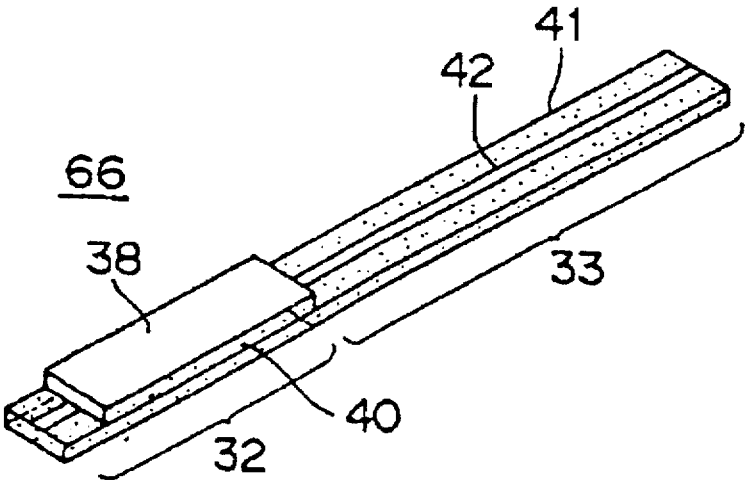
FIG. 16

ANTENNA-INTEGRATED STRIP LINE CABLE

BACKGROUND OF THE INVENTION

This invention relates to an antenna-integrated strip line cable (a strip line cable having an antenna integrated therein), and particularly to an antenna-integrated strip line cable for use in a high-frequency appliance or the like.

Small high-frequency appliances such as portable telephones include those having the construction shown in FIG. 24. Inside this high-frequency appliance, a coaxial cable 94 is used as a transmission line between an antenna 91 and a circuit board 92. Electrical connection of the coaxial cable 94 to the circuit board 92 has been carried out by means of a connector 93. Electrical connection of the coaxial cable 94 to the antenna 91, on the other hand, has generally been carried out by means of soldering or in some cases by means of a connector. In FIG. 24, reference numeral 95 denotes a case.

In a conventional small high-frequency appliance, because it is necessary to use soldering or a connector for electrical connection of the antenna 91 to the coaxial cable 94, this has increased manufacturing costs.

Also, because the impedance of the antenna 91 generally is not 50Ω, to suppress effects such as return loss resulting from impedance mismatching between the antenna 91 and the coaxial cable 94, an impedance matching circuit may be externally provided between the antenna 91 and the coaxial cable 94. However, in this case there is the new problem that the size of the appliance must be increased to make room for the external impedance matching circuit.

SUMMARY OF THE INVENTION

Accordingly, it is an object of this invention to provide an antenna-integrated strip line cable with which it is possible to improve the performance of a high-frequency appliance such as a portable telephone without increasing the size of the appliance.

To achieve the above object and other objects, a first aspect of the invention provides an antenna-integrated strip line cable comprising:

(a) a transmission line part having two conductors disposed in parallel, a first insulator disposed between these two conductors and a first central conductor disposed inside this first insulator, and (b) an antenna part having a second insulator extending from the first insulator and a second central conductor extending from the first central conductor and disposed on the surface of the second insulator.

A second aspect of the invention provides an antenna-integrated strip line cable comprising:

(c) a transmission line part having a housing made up of conductors and conductive side walls, a first insulator disposed inside this housing and a first central conductor disposed inside this first insulator, and (d) an antenna part having a second insulator extending from the first insulator and a second central conductor extending from the first central conductor and disposed on the surface of the second insulator.

A third aspect of the invention provides an antenna-integrated strip line cable described above wherein one of the conductors has an extension portion forming a counterpoise extending at an angle with respect to the antenna part. Here, preferably, the length of the extension portion is about ¼ of the wavelength λ of the frequency used.

A fourth aspect of the invention provides an antenna-integrated strip line cable described above wherein the first and second insulators are made of a material having plasticity or a material having flexibility.

A fifth aspect of the invention provides an antenna-integrated strip line cable described above wherein the first central conductor in the transmission line part is provided with an impedance matching circuit.

In the antenna-integrated strip line cables provided by the first and second aspects of the invention, because the transmission line part and the antenna part are integrated, it is not necessary to electrically connect an antenna to a coaxial cable as it has been conventionally.

In the antenna-integrated strip line cable provided by the third aspect of the invention, the extension portion extending in a different direction than the antenna part functions as a counterpoise; as a result, a good grounding effect is obtained and directivity of the antenna part is corrected.

In the antenna-integrated strip line cable provided by the fourth aspect of the invention, because the first and second insulators are made of a material having plasticity or a material having flexibility, the transmission line part can be easily bent to conform to the shape of a high-frequency appliance and the antenna part also has pliancy and is resistant to mechanical stresses from outside.

In the antenna-integrated strip line cable provided by the fifth aspect of the invention, because an impedance matching circuit is built into the transmission line part, it is unnecessary to provide an impedance matching circuit externally.

BRIEF DESCRIPTION OF THE DRAWINGS

FIG. 1 is a perspective view of a first preferred embodiment of an antenna-integrated strip line cable according to the invention;

FIG. 2 is a sectional view of the antenna-integrated strip line cable shown in FIG. 1;

FIG. 3 is a sectional view illustrating a stage in a procedure for manufacturing the antenna-integrated strip line cable shown in FIG. 1;

FIG. 7 is a perspective view illustrating an example of a way of using the antenna-integrated strip line cable shown in FIG. 1;

FIG. 8 is a graph showing directivity of an antenna part of the antenna-integrated strip line cable shown in FIG. 7;

FIG. 9 is a perspective view illustrating another example of a way of using the antenna-integrated strip line cable shown in FIG. 1;

FIG. 10 is a graph showing directivity of an antenna part of the antenna-integrated strip line cable shown in FIG. 9;

FIG. 15 is a perspective view of a fourth preferred embodiment of an antenna-integrated strip line cable according to the invention;

FIG. 16 is a perspective view of a fifth preferred embodiment of an antenna-integrated strip line cable according to the invention;

DETAILED DESCRIPTION OF PREFERRED EMBODIMENTS OF THE INVENTION

Figure 4:
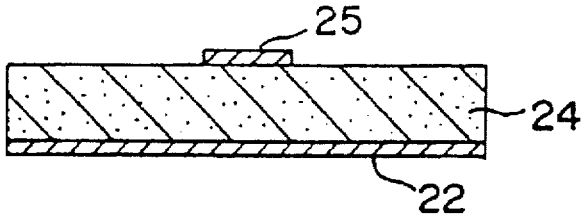
FIG. 4 is a sectional view illustrating another stage in the procedure for manufacturing the antenna-integrated strip line cable shown in FIG. 1.

Preferred embodiments of an antenna-integrated strip line cable according to the invention will now be described with reference to the accompanying drawings. In these embodiments, equivalent parts and portions of parts have been given the same reference numerals.

(First Preferred Embodiment, FIGS. 1–10)

As shown in FIG. 1, an antenna-integrated strip line cable 1 according to a first preferred embodiment of the invention is made up of a transmission line part 2, an antenna part 3 and a counterpoise 4, all integrated together. The transmission line part 2, as shown in FIG. 2, is made up of two conductors 21, 22 disposed in parallel, insulators 23, 24 disposed between these two conductors 21, 22, and a central conductor 25 disposed between the insulators 23 and 24, centrally in the width direction thereof. One end portion 2a of the transmission line part 2 extends orthogonally with respect to the main length direction of the strip line cable 1. One end of the central conductor 25 is exposed at the end of this end portion 2a. Wide-pattern impedance matching circuits 26a, 26b are provided in the central conductor 25.

If the width and thickness of the central conductor 25 are respectively W and t, the relative permittivity of the insulators 23, 24 is $\epsilon r$ and the sum of the thicknesses of the insulators 23, 24 is b, then the characteristic impedance Zo of the transmission line part 2 can be obtained from equation (1) below, when $W/(b-t) \geqq 0.35$; and can be obtained from equation (2) below when $W/(b-t) < 0.35$, $t/b \leqq 0.25$, and $t/W \leqq 0.11$.

$$Z_0 = \frac{94.15}{\sqrt{\epsilon_r}\left\{\frac{W/b}{(1-t/b)} + \frac{Cf}{0.00885\epsilon_r}\right\}} \quad \text{(Eq. 1)}$$

$$Z_0 = \frac{60}{\sqrt{\epsilon_r}} \ln\left(\frac{4b}{\pi\alpha_0}\right) \quad \text{(Eq. 2)}$$

wherein:

$$Cf = \frac{0.00885\epsilon_r}{\pi}\left[\frac{2}{(1-t/b)} \ln\left\{\frac{1}{(1-t/b)} + 1\right\} - \left\{\frac{1}{(1-t/b)} - 1\right\} \ln\left\{\frac{1}{(1-t/b)^2} - 1\right\}\right]$$

and wherein:

$$\alpha_0 = \frac{W}{2}\left[1 + \frac{t}{\pi W}\left\{1 + \ln\frac{4\pi W}{t}\right\} + 0.51\left(\frac{t}{W}\right)^2\right]$$

As is clear from equations (1) and (2), for a given characteristic impedance Zo, if the thickness t of the central conductor 25 is made small then the total thickness b of the insulators 23, 24 also becomes small. Because the central conductor 25 can be made from a thin film such as a sputtered film or a vapor-deposited film, it is easy to make the thickness t of the central conductor 25 small.

The antenna part 3 comprises portions of the insulator 24 and the central conductor 25 which extend from the transmission line part 2. The central conductor 25 is disposed on the upper surface of the insulator 24, centrally in the width direction of the insulator 24. The conductor 22 is not on the lower surface of the insulator 24 of the antenna part 3.

The counterpoise 4 comprises portions of the insulator 23 and the conductor 21 which extend from the transmission line part 2. The counterpoise 4 is perpendicular to the antenna part 3, and the length of the counterpoise 4 is about one-fourth of the wavelength λ of the frequency used. As a result of the length of the counterpoise 4 being set to about λ/4, the impedance of the transmission line side as seen from the antenna is low and a good grounding effect is obtained.

Next, an example of a method for manufacturing the antenna-integrated strip line cable 1 will be described.

Figure 5:
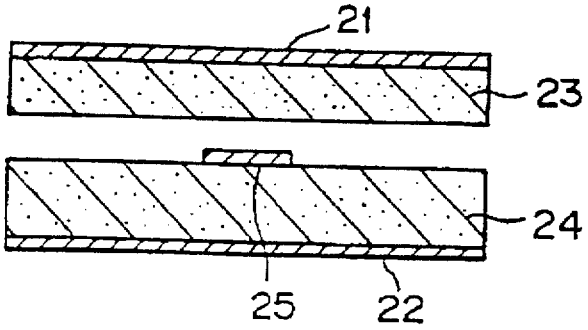
FIG. 5 is a sectional view illustrating another stage in the procedure for manufacturing the antenna-integrated strip line cable shown in FIG. 1.

First, as shown in FIG. 3, the insulator 24 whose entire upper and lower surfaces are covered by conductors 25', 22' is prepared. Then, as shown in FIG. 4, unneeded portions of the conductors 25' and 22' are removed by etching, whereby the central conductor 25 is formed on the upper surface of the insulator 24 and the conductor 22 of the transmission line part 2 is formed on the lower surface of the insulator 24. Next, as shown in FIG. 5, the insulator 23 whose entire upper surface is covered by the conductor 21 is prepared and this insulator 23 and the insulator 24 with the etched conductors 25 and 22 thereon are joined, only in the transmission line part 2, with an adhesive sheet or another type of adhesive. The portion of the insulator 23 not thus joined to the insulator 24 is bent perpendicular to the antenna part 3 and becomes the counterpoise 4.

Here, as the material of the insulators 23, 24, a material having plasticity or flexibility is used. Specifically, fluorine resin, polyethylene resin, polypropylene resin and the like, which are low-loss materials, are used. As the material of the conductors 21, 22 and the central conductor 25, a metal such as copper having excellent conductivity is used.

Figure 6:
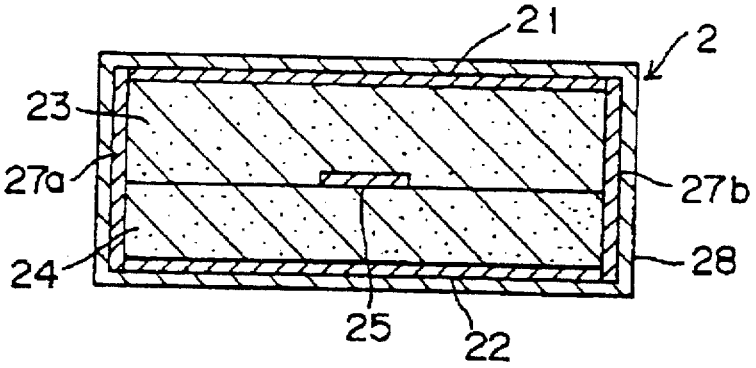
FIG. 6 is a sectional view illustrating another stage in the procedure for manufacturing the antenna-integrated strip line cable shown in FIG. 1.

If necessary, as shown in FIG. 6, to prevent leakage of signals to the outside, in the transmission line part 2 only, conducting side walls 27a, 27b may be provided and the central conductor 25 may be covered and shielded by the conductors 21, 22 and the side walls 27a, 27b. The side walls 27a, 27b may be formed by for example coating a conductive paste or affixing a metal foil. Also, the entire antenna-integrated strip line cable 1 may be covered with an insulating film 28 to provide insulation from other parts.

An example of this antenna-integrated strip line cable 1 fitted to a portable high-frequency appliance is shown in FIG. 7. The antenna-integrated strip line cable 1 is fixed to the end of the outer surface of a metal case 6 of the high-frequency appliance, and the end portion 2a of the transmission line part 2 is bent and electrically connected by way of a connector 8 to a circuit board 7 inside the high-frequency appliance. The conductor 21 in the counterpoise 4 is in contact with the end surface of the metal case 6. Electromagnetic waves fed into the transmission line part 2 from the circuit board 7 by way of the connector 8 are guided to the antenna part 3 by the central conductor 25 and then radiated from the antenna part 3. Also, because the transmission line part 2 and the antenna part 3 are reversible devices, they can be used for reception as well as transmission.

Because in the antenna-integrated strip line cable 1 the transmission line part 2 and the antenna part 3 are integrated, the number of parts is reduced and the work of connecting an antenna part to a coaxial cable as has conventionally been necessary is eliminated. Also, because the insulators 23, 24 are made of a material having plasticity or flexibility, the transmission line part 2 can be easily bent to conform to the shape of the high-frequency appliance, and the antenna part 3 also has pliancy and is not readily damaged by mechanical stress from outside. Because it is easy to form the impedance matching circuits 26a, 26b and they can be built into the transmission line part 2, external provision of impedance matching circuits is unnecessary and consequently it is possible to reduce the size of the high-frequency appliance.

When the antenna-integrated strip line cable 1 is fitted to the end of a high-frequency appliance as shown in FIG. 7, it sometimes happens that due to currents flowing through the metal case 6, electromagnetic waves are directed toward the high-frequency appliance so that some directivity biased in the direction of the case 6 arises in the antenna part 3, as shown in FIG. 8 (see curve 9).

In this situation, by disposing the counterpoise 4 of the antenna-integrated strip line cable 1 on the side thereof opposite to the high-frequency appliance and bending it into an L-shape, as shown in FIG. 9, it is possible to make the antenna part 3 non-directional, as shown in FIG. 10 (see curve 10). In this first preferred embodiment the frequency used is 1.9 GHz and in FIG. 9 the dimension C is 38 mm, the dimension d is 23 mm and the dimension e is 15 mm.

Figure 11:
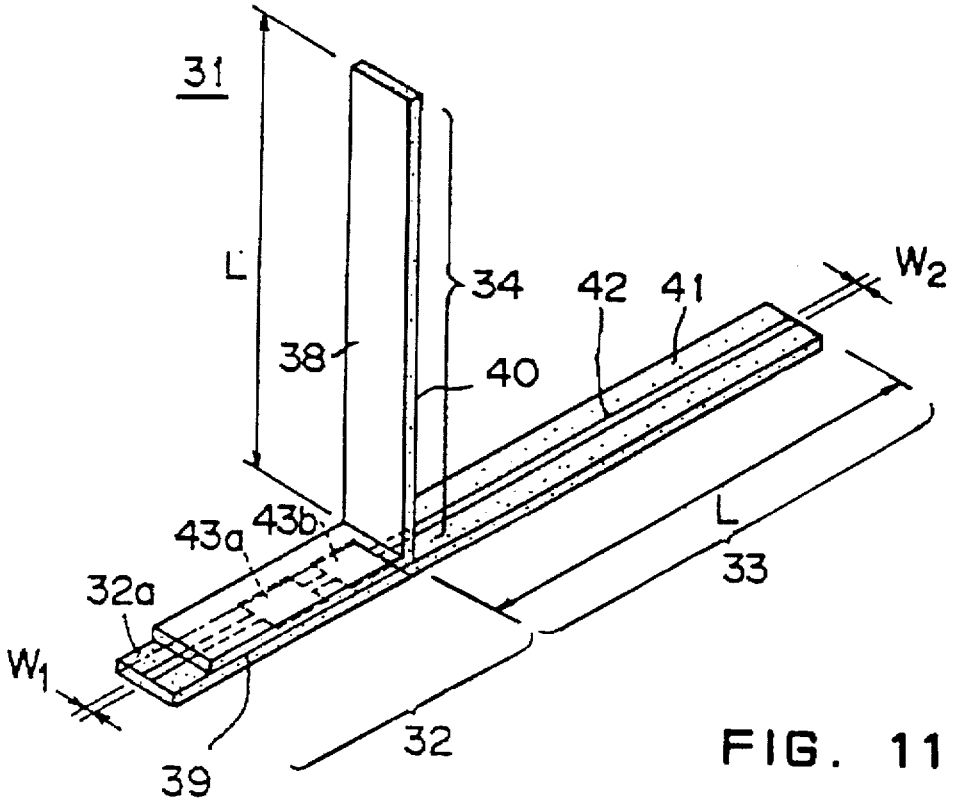
FIG. 11 is a perspective view of a second preferred embodiment of an antenna-integrated strip line cable according to the invention.
Figure 12:
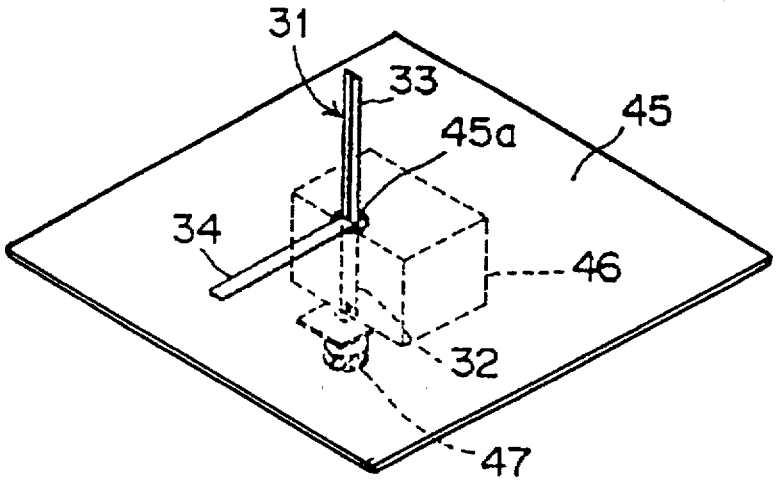
FIG. 12 is a perspective view of a device for measuring return loss of the antenna-integrated strip line cable shown in FIG. 11.
Figure 13:
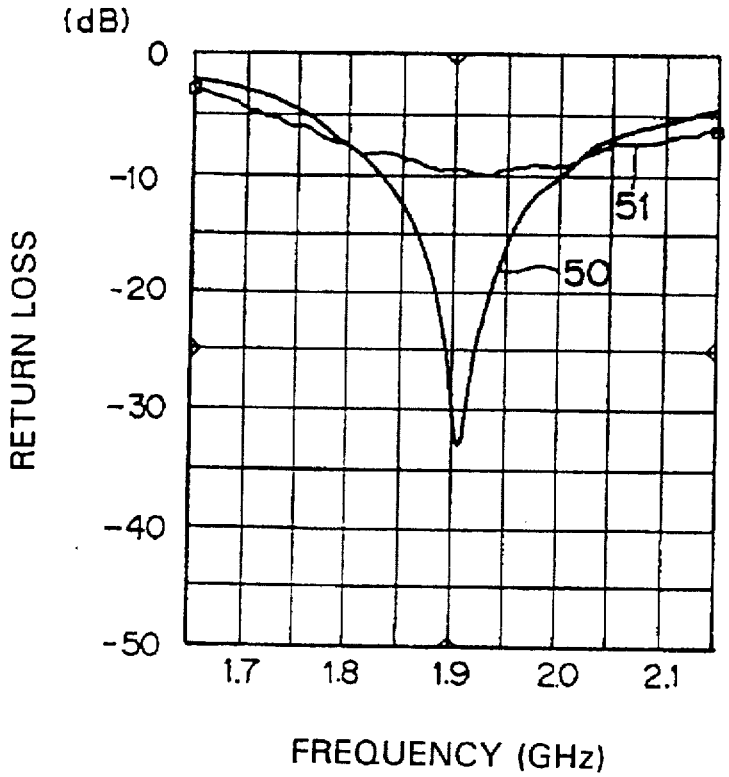
FIG. 13 is a graph showing return loss of the antenna-integrated strip line cable shown in FIG. 11.

(Second Preferred Embodiment, FIG. 11 to FIG. 13)

As shown in FIG. 11, an antenna-integrated strip line cable 31 according to a second preferred embodiment of the invention comprises a transmission line part 32, an antenna part 33 and a counterpoise 34, all integrated together. The transmission line part 32 is made up of two conductors 38, 39 disposed in parallel, insulators 40, 41 disposed between these two conductors 38, 39 and a central conductor 42 disposed between the insulators 40, 41, centrally in the width direction thereof. In one end portion 32a of the transmission line part 32 the insulator 40 is partially cut away and the central conductor 42 is exposed. Wide-pattern impedance matching circuits 43a, 43b are provided in the central conductor 42.

The antenna part 33 comprises portions of the insulator 41 and the central conductor 42 which extend from the transmission line part 32. The counterpoise 34 comprises portions of the insulator 40 and the conductor 38 which extend from the transmission line part 32. The counterpoise 34 is perpendicular to the antenna part 33, and the length of the counterpoise 34 is one fourth of the wavelength $\lambda$ of the frequency used. As the material of the insulators 40, 41, a material having plasticity and flexibility is used.

The return loss of this antenna-integrated strip line cable 31 at the frequency of 1.9 GHz was measured using the apparatus shown in FIG. 12. This measuring apparatus comprises a grounded copper plate 45 of a large surface area and a brass mounting jig 46 and an SMA connector 47 fixed to the central portion of the underside of the copper plate 45. The transmission line part 32 of the antenna-integrated strip line cable 31 is fitted to the jig 46 and the SMA connector 47 is soldered to the central conductor 42 exposed on the end portion 32a of the transmission line part 32. The antenna part 33 passes through a hole 45a in the central portion of the copper plate 45 and projects from the upper surface of the copper plate 45. The counterpoise 34 is in contact with the upper surface of the copper plate 45.

In the antenna-integrated strip line cable 31, the length L of the antenna part 33 and the counterpoise 34 is 35 mm, the width W2 of the central conductor 42 in the antenna part 33 is 0.4 mm and the length of the transmission line part 32 is 17.7 mm.

Two antenna-integrated strip line cables 31 were prepared, one in which the width W1 of the central conductor 42 in the transmission line part 32 is 0.4 mm and the characteristic impedance Zo of the transmission line part 32 is 50Ω, and the other in which the width W1 of the central conductor 42 in the transmission line part 32 is 0.8 mm and the characteristic impedance Zo of the transmission line part 32 is 32Ω.

FIG. 13 is a graph of measured results obtained with these two antenna-integrated strip line cables 31. In the case wherein the characteristic impedance Zo of the transmission line part 32 was 50Ω, the return loss was about −10 dB (see curve 51). In the case wherein the characteristic impedance Zo of the transmission line part 32 was 32Ω, on the other hand, the return loss was reduced to more than about −25 dB (see curve 50). Because it is easy to change the width of the central conductor 42 in the transmission line part 32 and the impedance matching circuits 43a, 43b in this way, for example by etching, good impedance matching of the transmission line part 32 and the antenna part 33 can easily be obtained.

Figure 14:
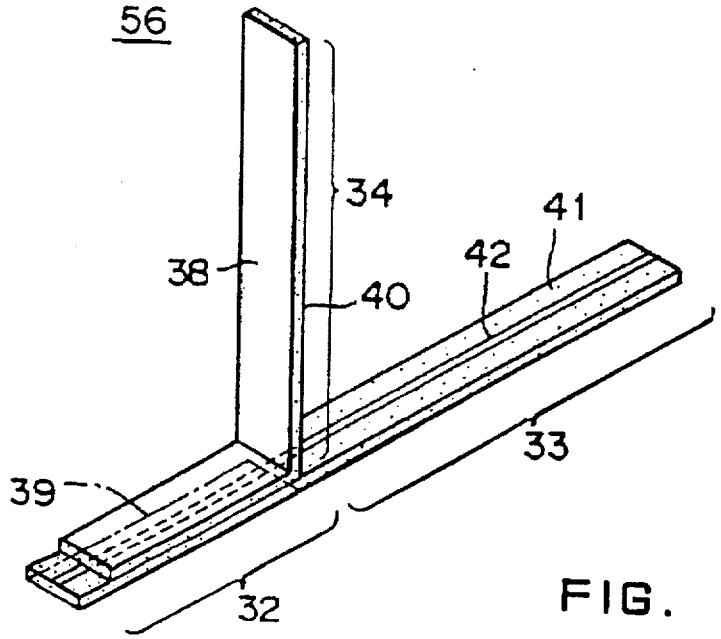
FIG. 14 is a perspective view of a third preferred embodiment of an antenna-integrated strip line cable according to the invention.

(Third Preferred Embodiment, FIG. 14)

As shown in FIG. 14, an antenna-integrated strip line cable 56 according to a third preferred embodiment of the invention does not have an impedance matching circuit provided in the central conductor 42 of the transmission line part 32. No impedance matching circuit is provided in this preferred embodiment because, by providing a suitable shape of the case of the high-frequency appliance and grounding state of the transmission line part 32, the impedance of the antenna part 33 can be arranged to be 50Ω so that no matching circuit is necessary.

(Fourth and Fifth Preferred Embodiments, FIGS. 15–16)

As shown in FIG. 15, in an antenna-integrated strip line cable 61 according to a fourth preferred embodiment of the invention, the length L of the counterpoise 34 is shorter than ¼ of the wavelength λ of the frequency used. As shown in FIG. 16, an antenna-integrated strip line cable 66 according to a fifth preferred embodiment of the invention does not have a counterpoise. In these cases, although there may be less correction of the directivity of the antenna part 33 than when the length L of the counterpoise 34 is λ/4, these embodiments have the merit that the high-frequency appliance can be made smaller. In these fourth and fifth preferred embodiments, and in the sixth, seventh and eighth preferred embodiments described below, an impedance matching circuit may be provided in the central conductor 42 in the transmission line part 32 or alternatively may be dispensed with.

Figure 17:
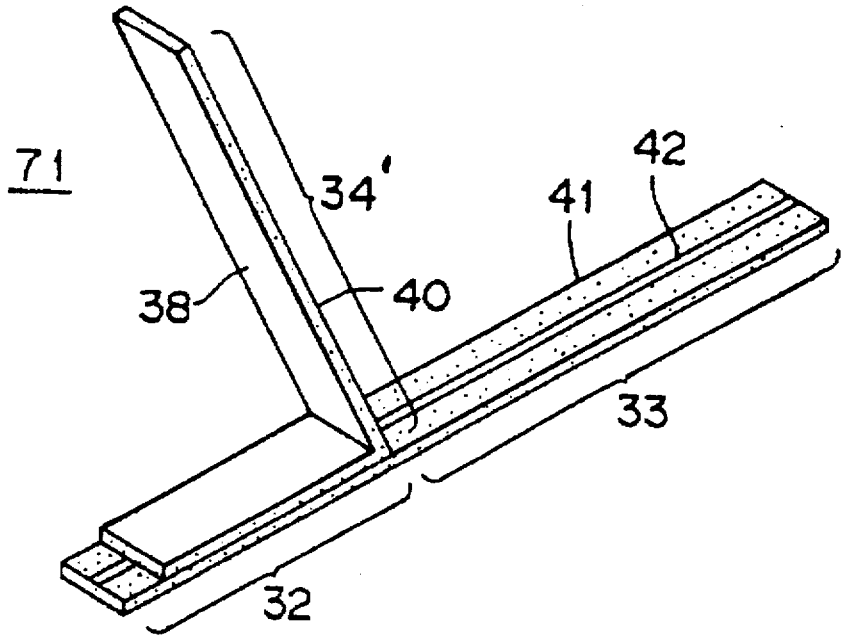
FIG. 17 is a perspective view of a sixth preferred embodiment of an antenna-integrated strip line cable according to the invention.

(Sixth Preferred Embodiment, FIG. 17)

As shown in FIG. 17, in an antenna-integrated strip line cable 71 according to a sixth preferred embodiment of the invention, directivity of the antenna part 33 is corrected by a counterpoise 34' which is not perpendicular to the antenna part 33 but rather is inclined at an obtuse angle with respect thereto.

Figure 18:
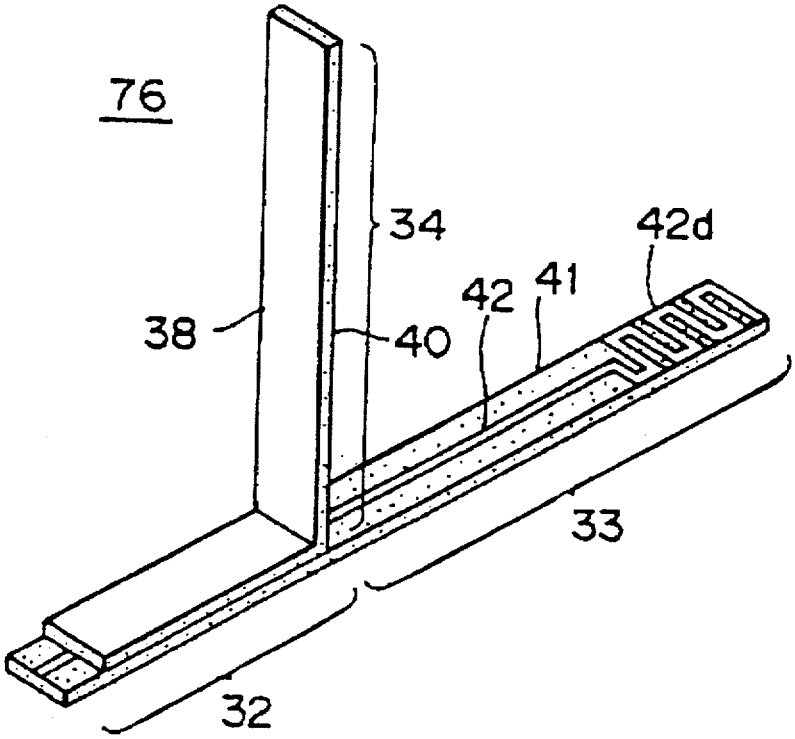
FIG. 18 is a perspective view of a seventh preferred embodiment of an antenna-integrated strip line cable according to the invention.
Figure 19:
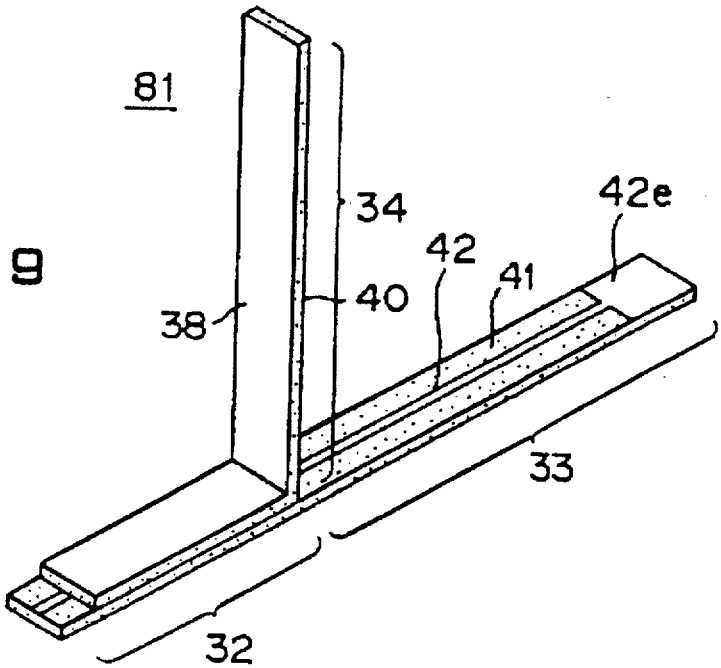
FIG. 19 is a perspective view of an eighth preferred embodiment of an antenna-integrated strip line cable according to the invention.

(Seventh and Eighth Preferred Embodiments, FIGS. 18–19)

As shown in FIG. 18, in an antenna-integrated strip line cable 76 according to a seventh preferred embodiment of the invention, an end portion 42*d* of the central conductor 42 at the end of the antenna 33 is formed with a snaking pattern and the central conductor 42 is thereby made longer without the antenna part 33 being made longer. As shown in FIG. 19, in an antenna-integrated strip line cable 81 according to an eighth preferred embodiment of the invention, an end portion 42*e* of the central conductor 42 at the end of the antenna part 33 is widened and the electric current distribution in the antenna part 33 is thereby altered. These modified central conductors 42 can be easily formed by etching a conducting film.

Figure 20:
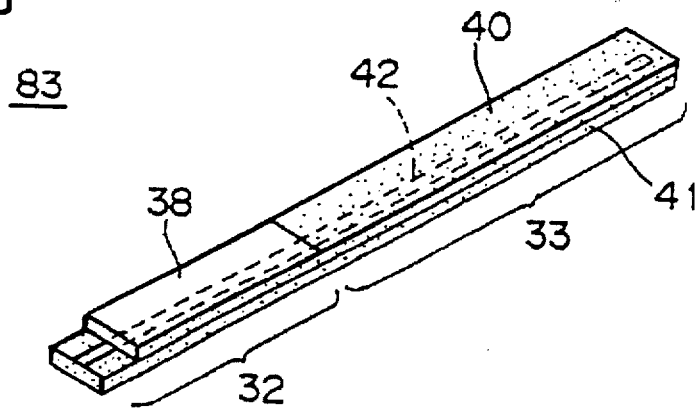
FIG. 20 is a perspective view of a ninth preferred embodiment of an antenna-integrated strip line cable according to the invention.

(Ninth Preferred Embodiment, FIG. 20)

As shown in FIG. 20, in an antenna-integrated strip line cable 83 according to a ninth preferred embodiment of the invention, the insulators 40, 41 are joined together not only in the transmission line part 32 but also in the antenna part 33. The portion of the conductor 38 disposed on the upper surface of the insulator 40 in the antenna part 33 is removed by etching and the portion of the conductor 38 in the transmission line part 32 is left. On the underside of the insulator 41 a conductor is formed only in the transmission line part 32. In this antenna-integrated strip line cable 83, because the central conductor 42 is sandwiched between the insulators 40, 41, neither tensile stresses nor compressive stresses act on the central conductor 42 when the antenna part 33 is bent. Consequently, the central conductor 42 does not readily break and has better bending endurance. As a result, the antenna part 33 can be made foldable.

(Other Preferred Embodiments)

The antenna-integrated strip line cable of this invention is not limited to the preferred embodiments described above, and various changes can be made to these preferred embodiments within the scope of the invention.

Figure 21:
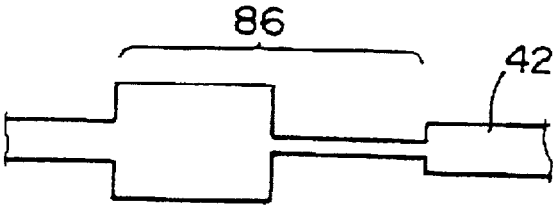
FIG. 21 is a plan view of an impedance matching circuit used in another preferred embodiment.
Figure 22:
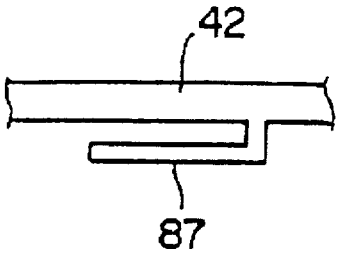
FIG. 22 is a plan view of an impedance matching circuit used in another preferred embodiment.
Figure 23:
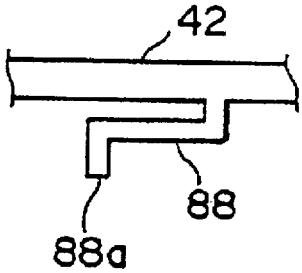
FIG. 23 is a plan view of an impedance matching circuit used in a further preferred embodiment.
Figure 24:
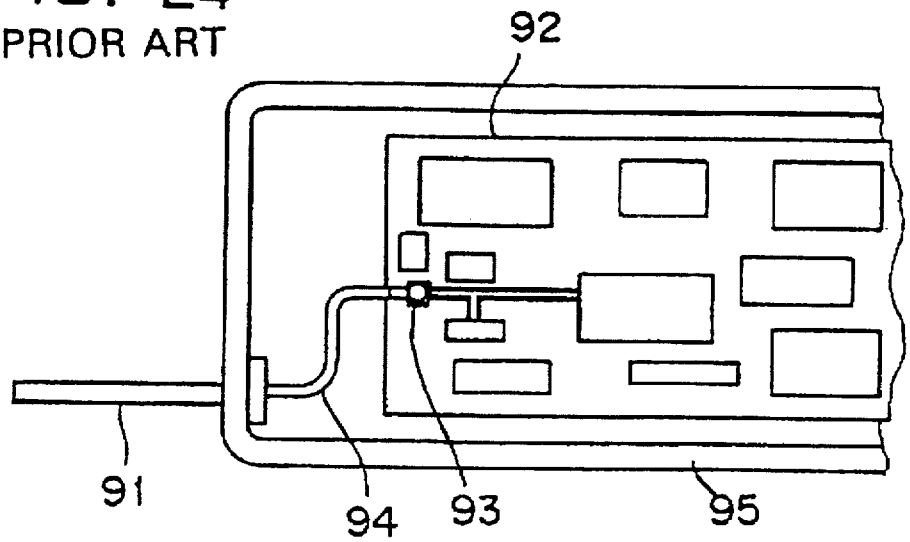
FIG. 24 PRIOR ART
FIG. 24 is a plan view of the inside of a small high-frequency appliance in which a conventional coaxial cable is used.

As an impedance matching circuit provided in the central conductor of the transmission line part, besides those shown in the preferred embodiments described above, a pattern 86 having sections with different widths as shown in FIG. 21, or a stub 87 or 88 as shown respectively in FIG. 22 and FIG. 23 can be used. In particular, as shown in FIG. 23, the stub 88 has its end 88*a* projecting from the side surface of the transmission line part and electrically connected to ground.

Also, when the central conductor of the antenna part is exposed to air there is a danger of the central conductor being corroded by moisture in the air. To prevent this, an insulating film may be adhered to the upper surface of the antenna part or a protective film may be formed on the antenna part by spraying an insulating material thereon.

As is clear from the above description, according to this invention, because a transmission line part and an antenna part are integrated, the number of parts is reduced, the work of connecting a coaxial cable to an antenna is made unnecessary and manufacturing costs can be reduced. Also, an extension portion oriented in a different direction to the antenna part can be made to function as a counterpoise and improve the directivity of the antenna part.

Furthermore, because the first and second insulators are made from a material having plasticity or flexibility, the transmission line part can easily be bent to conform to the shape of a high-frequency appliance, and because the antenna part also has pliancy an antenna-integrated strip line cable not readily damaged by mechanical stress from outside can be obtained. Also, because impedance matching circuits can be built into the transmission line part easily, external provision of an impedance matching circuit is not necessary and it is possible to reduce the size of the high-frequency appliance.

Although the present invention has been described in relation to particular embodiments thereof, many other variations and modifications and other uses will become apparent to those skilled in the art. Therefore, the present invention is not limited by the specific disclosure herein, but only by the appended claims.

What is claimed is:

1. An antenna-integrated strip line cable comprising:

a transmission line part having upper and lower conductors disposed in parallel, a first insulator disposed between the two conductors and a first central conductor disposed inside the first insulator;

an antenna part having a second insulator extending from the first insulator and a second central conductor extending from the first central conductor and disposed on a surface of the second insulator; and a counterpoise part extending from one of the upper and lower conductors, said counterpoise rising from the surface of the second insulator.

2. An antenna-integrated trip line cable according to claim 1, further comprising:

a housing made up of upper and lower conductors and conductive side walls extending therebetween, said transmission line part being disposed in said housing.

3. An antenna-integrated strip line cable according to claim 1 or 2 wherein the counterpoise part extends from one of the upper and lower conductors at an angle with respect to the antenna part.

4. An antenna-integrated strip line cable according to claim 1, further comprising a signal having an operating frequency supplied to said transmission line part, and wherein the length of the counterpoise part is about ¼ of the wavelength λ of said operating frequency.

5. An antenna-integrated strip line cable according to claim 1 or 2, wherein:

the first and second insulators are made of a material having plasticity or a material having flexibility.

6. An antenna-integrated strip line cable according to claim 1 or 2, further comprising an impedance matching circuit connected to the first central conductor in the transmission line part.

7. An antenna-integrated strip line cable according to claim 6, wherein said first central conductor has a first width and said impedance matching circuit comprises a first wide pattern conductor in series with said first central conductor and having a second width which is greater than said first width.

8. An antenna-integrated strip line cable according to claim 7, further comprising a second wide pattern conductor in series with said first wide pattern conductor and said first central conductor.

9. An antenna-integrated strip line cable according to claim 8, wherein the first and second wide pattern conductors have substantially the same width.

10. An antenna-integrated strip line cable according to claim 8, wherein the first and second wide pattern conductors have substantially different respective widths.

11. An antenna-integrated strip line cable according to claim 6, wherein said impedance matching circuit comprises a stub extending from said first central conductor.

12. An antenna-integrated strip line cable according to claim 1, wherein said counterpoise part extends at a right angle to the antenna part.

13. An antenna-integrated strip line cable according to claim 1, wherein said counterpoise part extends at an obtuse angle to the antenna part.

14. An antenna-integrated strip line cable according to claim 1, wherein said counterpoise part is substantially straight.

15. An antenna-integrated strip line cable according to claim 1, wherein said counterpoise part includes a bend.

16. An antenna-integrated strip line cable according to claim 1 wherein said transmission line part has a bend to contact with an external device.

17. A method of producing an antenna-integrated strip line cable comprising the steps of:

preparing a first insulative substrate having conductors on upper and lower main surfaces of said first substrate;

preparing a second insulative substrate having a conductor on a first surface;

disposing said second substrate on said first substrate so that said upper surface of said first substrate and a second surface of said second substrate contact each other; and bending said second substrate at a predetermined position so that a part of said second substrate rises from said upper surface of said first substrate.

18. A method of producing an antenna-integrated strip line cable according to claim 17, further comprising the step of:

disposing adhesive between said first and second substrates.

19. A method of producing an antenna-integrated strip line cable according to claim 17, further comprising the step of:

forming a conductor pattern by etching said conductor on the upper surface of the first substrate.

* * * * *